US009022217B2

(12) United States Patent
Holley, Jr.

(10) Patent No.: US 9,022,217 B2
(45) Date of Patent: May 5, 2015

(54) CARTON WITH ARTICLE PROTECTION FEATURE

(71) Applicant: Graphic Packaging International, Inc., Atlanta, GA (US)

(72) Inventor: John Murdick Holley, Jr., Lawrenceville, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 13/827,180

(22) Filed: Mar. 14, 2013

(65) Prior Publication Data

US 2013/0220873 A1 Aug. 29, 2013

Related U.S. Application Data

(63) Continuation-in-part of application No. 13/419,740, filed on Mar. 14, 2012.

(60) Provisional application No. 61/518,504, filed on May 6, 2011, provisional application No. 61/572,638, filed (Continued)

(51) Int. Cl.
*B65D 5/50* (2006.01)
*B31B 3/00* (2006.01)
(Continued)

(52) U.S. Cl.
CPC ... *B65D 5/50* (2013.01); *B31B 3/00* (2013.01); *B65D 71/10* (2013.01); *B65D 71/36* (2013.01);
(Continued)

(58) Field of Classification Search
CPC ..... B65D 71/10; B65D 71/36; B65D 5/5002; B65D 5/5007; B65D 5/50; B65D 5/5009; B65D 5/5004
USPC ..... 206/593, 784, 521, 139, 140, 147, 427, 206/433, 434, 591, 592, 193, 586; 53/456
See application file for complete search history.

(56) References Cited

U.S. PATENT DOCUMENTS 2,331,137 A 10/1943 Rous
2,877,894 A 3/1959 Forrer
(Continued)

FOREIGN PATENT DOCUMENTS

EP 0 024 782 A1 3/1981
EP 332 153 B1 9/1991
(Continued)

OTHER PUBLICATIONS

International Search Report and Written Opinion for PCT/US2012/029022 dated Sep. 26, 2012.
(Continued)

*Primary Examiner* — Andrew Perreault
(74) *Attorney, Agent, or Firm* — Womble Carlyle Sandridge & Rice, LLP

(57) ABSTRACT

A carton for containing at least one article. The carton comprises a plurality of panels that extends at least partially around an interior of the carton. At least two end flaps are respectively foldably connected to respective panels of the plurality of panels. The at least two end flaps are at least partially overlapped with respect to one another to thereby at least partially form a closed end of the carton. At least one end flap of the at least two end flaps is connected to a respective panel of the plurality of panels by a connecting panel. The carton further comprises an article protection feature for protecting the at least one article. The article protection feature can be positioned on the connecting panel.

28 Claims, 8 Drawing Sheets

Related U.S. Application Data on Jul. 19, 2011, provisional application No. 61/627,249, filed on Oct. 7, 2011, provisional application No. 61/548,779, filed on Oct. 19, 2011, provisional application No. 61/570,044, filed on Dec. 13, 2011, provisional application No. 61/689,254, filed on Jun. 1, 2012.

(51) Int. Cl.

| | |
|---|---|
| ***B65D 71/10*** | (2006.01) |
| ***B65D 71/36*** | (2006.01) |
| ***B65B 21/24*** | (2006.01) |
| ***B65B 55/00*** | (2006.01) |
| ***B65B 61/00*** | (2006.01) |

(52) U.S. Cl.

CPC ..... *B65D 5/5002* (2013.01); *B65D 5/5007* (2013.01); *B65D 2571/0045* (2013.01); *B65D 2571/0066* (2013.01); *B65D 2571/00679* (2013.01); *B65D 2571/00728* (2013.01); *B65D 2571/00253* (2013.01); *B65D 2571/00265* (2013.01); *B65B 21/24* (2013.01); *B65B 55/00* (2013.01); *B65B 61/00* (2013.01)

(56) References Cited

U.S. PATENT DOCUMENTS

| | | | | |
|---|---|---|---|---|
| 3,152,688 | A | | 10/1964 | Mahon |
| 3,167,214 | A | | 1/1965 | Mahon |
| 3,176,902 | A | | 4/1965 | Champlin |
| 3,206,097 | A | | 9/1965 | Holmes |
| 3,252,649 | A | | 5/1966 | Graser et al. |
| 3,255,919 | A | | 6/1966 | Koolnis |
| 3,337,043 | A | | 8/1967 | Parker |
| 3,355,012 | A | | 11/1967 | Weiss |
| 3,367,557 | A | | 2/1968 | Farquhar |
| 3,386,570 | A | | 6/1968 | Lock |
| 3,432,029 | A | | 3/1969 | Brown |
| 3,669,342 | A | | 6/1972 | Funkhouser |
| 3,670,950 | A | | 6/1972 | Rossi |
| 3,679,121 | A | | 7/1972 | Morgese |
| 3,687,282 | A | | 8/1972 | Owen |
| 3,715,029 | A | | 2/1973 | Wood |
| 3,747,801 | A | | 7/1973 | Graser |
| 3,767,042 | A | | 10/1973 | Ganz |
| 3,797,729 | A | | 3/1974 | Holmes |
| 3,923,235 | A | | 12/1975 | Roccaforte |
| 3,942,631 | A | | 3/1976 | Sutherland et al. |
| 3,963,121 | A | | 6/1976 | Kipp |
| 3,977,518 | A | | 8/1976 | Arneson |
| 4,034,852 | A | | 7/1977 | Forrer |
| 4,093,068 | A | | 6/1978 | Smrt |
| 4,095,693 | A | * | 6/1978 | Killy ..... 206/433 |
| 4,095,735 | A | | 6/1978 | Stone |
| 4,101,069 | A | | 7/1978 | Wood |
| 4,131,230 | A | | 12/1978 | Koehlinger et al. |
| 4,146,168 | A | | 3/1979 | Hartline |
| 4,186,867 | A | | 2/1980 | Wood |
| 4,202,446 | A | | 5/1980 | Sutherland |
| 4,256,226 | A | | 3/1981 | Stone |
| 4,295,562 | A | | 10/1981 | Wood |
| 4,324,328 | A | | 4/1982 | Champlin |
| 4,328,891 | A | | 5/1982 | Elward |
| 4,330,079 | A | | 5/1982 | Wood |
| 4,398,631 | A | | 8/1983 | Graser |
| 4,421,232 | A | | 12/1983 | Konaka |
| 4,424,901 | A | | 1/1984 | Lanier |
| 4,437,606 | A | | 3/1984 | Graser |
| 4,438,843 | A | | 3/1984 | Graser |
| 4,463,852 | A | | 8/1984 | Stone |
| 4,465,180 | A | | 8/1984 | Klygis |
| 4,470,503 | A | | 9/1984 | Stone |
| 4,498,581 | A | | 2/1985 | Dutcher |
| 4,498,618 | A | | 2/1985 | Sutherland |
| 4,505,696 | A | | 3/1985 | Wright et al. |
| 4,533,047 | A | | 8/1985 | Calvert |
| 4,545,485 | A | | 10/1985 | Oliff |
| 4,574,997 | A | | 3/1986 | Ikeda |
| 4,600,140 | A | | 7/1986 | Milliens |
| 4,708,284 | A | | 11/1987 | Sutherland et al. |
| 4,883,168 | A | | 11/1989 | Dreyfus |
| 4,890,737 | A | | 1/1990 | Kadleck et al. |
| 4,890,738 | A | | 1/1990 | Carver |
| 4,919,266 | A | | 4/1990 | McIntosh, Jr. et al. |
| 4,925,019 | A | | 5/1990 | Ganz et al. |
| 5,002,186 | A | | 3/1991 | Cooper |
| 5,002,225 | A | | 3/1991 | Bienaime |
| D316,672 | S | | 5/1991 | Wood |
| 5,020,668 | A | | 6/1991 | Schuster |
| 5,022,525 | A | | 6/1991 | Schuster |
| 5,031,770 | A | | 7/1991 | Chaussadas |
| 5,044,503 | A | | 9/1991 | Wein |
| 5,080,280 | A | | 1/1992 | Kraus |
| 5,094,347 | A | | 3/1992 | Schuster |
| 5,107,986 | A | | 4/1992 | Cooper |
| 5,131,588 | A | | 7/1992 | Oliff |
| 5,145,067 | A | | 9/1992 | Carver |
| 5,158,177 | A | | 10/1992 | Negelen et al. |
| 5,167,325 | A | | 12/1992 | Sykora |
| 5,246,112 | A | | 9/1993 | Stout et al. |
| 5,297,673 | A | | 3/1994 | Sutherland |
| 5,310,050 | A | | 5/1994 | Sutherland |
| 5,311,984 | A | | 5/1994 | Harris |
| 5,328,080 | A | | 7/1994 | Holley, Jr. |
| 5,360,113 | A | | 11/1994 | Harris |
| 5,385,234 | A | | 1/1995 | Stout et al. |
| 5,390,784 | A | | 2/1995 | Sutherland |
| 5,390,848 | A | | 2/1995 | Gungner et al. |
| 5,437,363 | A | | 8/1995 | Gungner |
| 5,439,112 | A | | 8/1995 | De Guglielmo et al. |
| 5,443,203 | A | | 8/1995 | Sutherland |
| 5,472,090 | A | | 12/1995 | Sutherland |
| 5,476,217 | A | | 12/1995 | Moncrief et al. |
| 5,484,059 | A | | 1/1996 | Sutherland |
| 5,549,197 | A | | 8/1996 | Sutherland |
| 5,579,904 | A | | 12/1996 | Holley, Jr. |
| 5,582,289 | A | | 12/1996 | Wright |
| 5,595,291 | A | | 1/1997 | Negelen |
| 5,595,292 | A | | 1/1997 | Bates |
| 5,595,299 | A | | 1/1997 | LeBras |
| 5,605,228 | A | | 2/1997 | Baxter |
| 5,620,094 | A | | 4/1997 | Naumann |
| 5,653,340 | A | | 8/1997 | Daniel |
| 5,671,845 | A | | 9/1997 | Harris |
| 5,699,957 | A | | 12/1997 | Blin et al. |
| 5,765,685 | A | | 6/1998 | Roosa |
| 5,775,572 | A | | 7/1998 | Oliff |
| 5,941,389 | A | | 8/1999 | Gomes |
| 5,947,367 | A | | 9/1999 | Miller et al. |
| 5,975,286 | A | | 11/1999 | Oliff |
| 5,975,287 | A | | 11/1999 | Negelen |
| 5,979,645 | A | | 11/1999 | Holley, Jr. |
| 5,984,086 | A | | 11/1999 | Fousghee et al. |
| 6,149,002 | A | | 11/2000 | Tiramani et al. |
| 6,155,412 | A | | 12/2000 | LeBras et al. |
| 6,170,741 | B1 | | 1/2001 | Skolik et al. |
| 6,189,687 | B1 | | 2/2001 | Bakx |
| 6,213,297 | B1 | | 4/2001 | Gale |
| 6,241,083 | B1 | | 6/2001 | Harrelson |
| 6,247,585 | B1 | | 6/2001 | Holley, Jr. |
| 6,273,330 | B1 | | 8/2001 | Oliff et al. |
| 6,295,789 | B1 | | 10/2001 | Muller |
| 6,315,111 | B1 | | 11/2001 | Sutherland |
| 6,315,123 | B1 | | 11/2001 | Ikeda |
| 6,536,656 | B2 | | 3/2003 | Auclair et al. |
| 6,615,984 | B2 | | 9/2003 | Saulas et al. |
| 6,669,083 | B2 | | 12/2003 | Bates |
| 6,695,137 | B2 | | 2/2004 | Jones et al. |
| 6,877,600 | B2 | | 4/2005 | Sutherland |
| 6,896,130 | B2 | | 5/2005 | Theelen |
| 6,948,293 | B1 | | 9/2005 | Eckermann et al. |
| 6,983,874 | B2 | | 1/2006 | Bakx |
| 6,997,372 | B2 | | 2/2006 | Gasparowicz |

(56) References Cited

U.S. PATENT DOCUMENTS

| | | | | |
|---|---|---|---|---|
| 7,028,839 | B2 | 4/2006 | Belloli et al. | |
| 7,048,113 | B2 | 5/2006 | Gomes | |
| 7,063,208 | B2 | 6/2006 | Lebras | |
| 7,070,045 | B2 | 7/2006 | Theelen | |
| 7,134,547 | B2 | 11/2006 | Auclair | |
| 7,175,020 | B2 | 2/2007 | Sutherland et al. | |
| 7,234,591 | B2 | 6/2007 | LeBras et al. | |
| 7,374,038 | B2 | 5/2008 | Smalley | |
| 7,427,010 | B2 | 9/2008 | Sutherland | |
| 7,467,729 | B2 | 12/2008 | Lown et al. | |
| 7,699,215 | B2 * | 4/2010 | Spivey, Sr. | 229/240 |
| 7,703,666 | B2 * | 4/2010 | Hand et al. | 229/242 |
| 7,780,067 | B2 | 8/2010 | Holley, Jr. | |
| 7,913,844 | B2 | 3/2011 | Spivey, Sr. | |
| 8,061,587 | B2 | 11/2011 | Blin | |
| 8,070,052 | B2 | 12/2011 | Spivey, Sr. | |
| 8,376,214 | B2 * | 2/2013 | Spivey et al. | 229/200 |
| 2001/0017315 | A1 | 8/2001 | Baroudi | |
| 2004/0000494 | A1 | 1/2004 | Sutherland | |
| 2004/0164135 | A1 | 8/2004 | Gong et al. | |
| 2007/0056869 | A1 | 3/2007 | Tokarski | |
| 2007/0181658 | A1 | 8/2007 | Sutherland | |
| 2007/0215682 | A1 | 9/2007 | Bates et al. | |
| 2007/0277481 | A1 | 12/2007 | LeBras | |
| 2009/0032425 | A1 | 2/2009 | Perkinson | |
| 2009/0065559 | A1 | 3/2009 | Parkes | |
| 2009/0236408 | A1 | 9/2009 | Spivey, Sr. et al. | |
| 2010/0140336 | A1 | 6/2010 | Ho Fung | |
| 2011/0011924 | A1 | 1/2011 | Spivey, Sr. et al. | |
| 2011/0065558 | A1 | 3/2011 | Smalley | |
| 2011/0233091 | A1 | 9/2011 | Block et al. | |
| 2011/0284622 | A1 | 11/2011 | Boukredine | |
| 2011/0290867 | A1 | 12/2011 | Schemmel et al. | |
| 2012/0279897 | A1 | 11/2012 | Schmal et al. | |

FOREIGN PATENT DOCUMENTS

| | | | |
|---|---|---|---|
| EP | 630 825 | A2 | 12/1994 |
| EP | 0 901 969 | B1 | 4/2000 |
| EP | 1 065 151 | A1 | 1/2001 |
| EP | 1 103 481 | B1 | 8/2004 |
| EP | 1 010 637 | B1 | 9/2004 |
| EP | 1 125 858 | B1 | 9/2004 |
| EP | 1 381 545 | B1 | 10/2005 |
| EP | 1 334 043 | B1 | 12/2005 |
| EP | 1 151 935 | B1 | 8/2006 |
| EP | 1 513 737 | B1 | 11/2006 |
| EP | 2 055 648 | A1 | 5/2009 |
| EP | 1 749 755 | B1 | 12/2011 |
| FR | 2619363 | A1 | 2/1989 |
| FR | 2684078 | A3 | 5/1993 |
| JP | 11-124129 | A | 5/1999 |
| JP | 3039805 | | 3/2000 |
| JP | 2008 213894 | A | 9/2008 |
| WO | WO 92/09498 | | 6/1992 |
| WO | WO 93/14991 | A1 | 8/1993 |
| WO | WO 95/08489 | A1 | 3/1995 |
| WO | WO 2005/042370 | A1 | 5/2005 |
| WO | WO 2011/022145 | A1 | 2/2011 |
| WO | WO 2011/049947 | A1 | 4/2011 |

OTHER PUBLICATIONS

International Search Report and Written Opinion for PCT/US2013/031288 dated Jun. 13, 2013.

International Search Report and Written Opinion for PCT/US2014/037642 dated Sep. 5, 2014.

International Search Report and Written Opinion for PCT/US2014/033445 dated Sep. 5, 2014.

Supplementary European Search Report for EP 12 78 2928 dated Nov. 28, 2014.

* cited by examiner

CARTON WITH ARTICLE PROTECTION FEATURE

CROSS-REFERENCE TO RELATED APPLICATIONS

This application is a continuation-in-part of U.S. patent application Ser. No. 13/419,740, filed Mar. 14, 2012, which claims the benefit of U.S. Provisional Application No. 61/518,504, filed May 6, 2011, U.S. Provisional Application No. 61/572,638, filed Jul. 19, 2011, U.S. Provisional Application No. 61/627,249, filed Oct. 7, 2011, U.S. Provisional Application No. 61/548,779, filed Oct. 19, 2011, and U.S. Provisional Application No. 61/570,044, filed Dec. 13, 2011. This application claims the benefit of U.S. Provisional Patent Application No. 61/689,254, filed Jun. 1, 2012.

INCORPORATION BY REFERENCE

The entire contents of U.S. patent application Ser. No. 13/419,740, filed Mar. 14, 2012, U.S. Provisional Application No. 61/518,504, filed May 6, 2011, U.S. Provisional Application No. 61/572,638, filed Jul. 19, 2011, U.S. Provisional Application No. 61/627,249, filed Oct. 7, 2011, U.S. Provisional Application No. 61/548,779, filed Oct. 19, 2011, U.S. Provisional Application No. 61/570,044, filed Dec. 13, 2011, and U.S. Provisional Application No. 61/689,254, filed Jun. 1, 2012, are hereby incorporated by reference as if presented herein in their entirety.

BACKGROUND OF THE DISCLOSURE

The present disclosure generally relates to cartons for holding beverage containers or other types of articles. More specifically, the present disclosure relates to cartons having an article protection feature and/or article protection flap that protects the containers or articles from breakage.

SUMMARY OF THE DISCLOSURE

In one aspect, the disclosure is generally directed to a carton for containing at least one article. The carton comprises a plurality of panels that extends at least partially around an interior of the carton. At least two end flaps are respectively foldably connected to respective panels of the plurality of panels. The at least two end flaps are at least partially overlapped with respect to one another to thereby at least partially form a closed end of the carton. At least one end flap of the at least two end flaps is connected to a respective panel of the plurality of panels by a connecting panel. The carton further comprises an article protection feature for protecting the at least one article. The article protection feature can be positioned on the connecting panel.

In another aspect, the disclosure is generally directed to a blank for forming a carton for containing at least one article. The blank comprises a plurality of panels for at least partially extending around an interior of the carton formed from the blank and at least two end flaps respectively foldably connected to respective panels of the plurality of panels. The at least two end flaps are for being at least partially overlapped with respect to one another to at least partially form a closed end of the carton formed from the blank. At least one end flap of the at least two end flaps is connected to a respective panel of the plurality of panels by a connecting panel. The blank further comprises an article protection feature for protecting the at least one article when the carton is formed from the blank. The article protection feature is positioned on the connecting panel.

In another aspect, the disclosure is generally directed to a method of forming a carton for containing at least one article. The method comprises obtaining a carton blank comprising a plurality of panels, at least two end flaps respectively foldably connected to respective panels of the plurality of panels, and an article protection feature for protecting the at least one article. At least one end flap of the at least two end flaps is connected to a respective panel of the plurality of panels by a connecting panel, and the article protection feature is positioned on the connecting panel. The method further comprises forming an interior of the carton at least partially defined by the plurality of panels, the forming the interior of the carton comprising forming an open-ended sleeve. The method can also comprise at least partially forming a closed end of the carton by at least partially overlapping the at least two end flaps with respect to one another.

In another aspect, the disclosure is generally directed to a carton for containing at least one article. The carton can comprise a plurality of panels that extends at least partially around an interior of the carton. The plurality of panels can comprise at least a side panel foldably connected to a bottom panel. At least two end flaps are respectively foldably connected to respective panels of the plurality of panels. The at least two end flaps are at least partially overlapped with respect to one another to thereby at least partially form a closed end of the carton. The at least two end flaps can comprise at least a side end flap foldably connected to the side panel along a first fold line. The carton also can comprise a suspended corner panel at least partially defined by the first fold line and a second fold line extending in the side panel. The suspended corner panel can be spaced apart from the bottom panel.

In another aspect, the disclosure is generally directed to a blank for forming a carton for containing at least one article. The blank comprises a plurality of panels for at least partially extending around an interior of the carton formed from the blank. The plurality of panels can comprise at least a side panel foldably connected to a bottom panel. At least two end flaps are respectively foldably connected to respective panels of the plurality of panels. The at least two end flaps are for being at least partially overlapped with respect to one another to at least partially form a closed end of the carton formed from the blank. The at least two end flaps comprising at least a side end flap foldably connected to the side panel along a first fold line. The blank also can comprise a suspended corner panel at least partially defined by the first fold line and a second fold line extending in the second panel. The suspended corner panel can be spaced apart from the bottom panel.

In another aspect, the disclosure is generally directed to a method of forming a carton for containing at least one article. The method comprises obtaining a carton blank comprising a plurality of panels, at least two end flaps respectively foldably connected to respective panels of the plurality of panels, and a suspended corner panel. The plurality of panels comprises at least a side panel foldably connected to a bottom panel, and the at least two end flaps comprise a side end flap foldably connected to the side panel along a first fold line. The suspended corner panel is at least partially defined by the first fold line and a second fold line extending in the second panel. The suspended corner panel can be spaced apart from the bottom panel. The method further can comprise forming an interior of the carton at least partially defined by the plurality of panels. The forming the interior of the carton can comprise forming an open-ended sleeve. The method also can comprise at least partially forming a closed end of the carton by at least partially overlapping the at least two end flaps with respect to one another.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain a single article or a plurality of articles such as containers, bottles, cans, etc., and protection features of such cartons that protect the article or articles or containers from breakage, damage, or deformation. The article(s) can be used for packaging food and beverage products, for example, or any other item. The article(s) can be made from materials suitable in composition for packaging the particular food or beverage item, or other item, and the materials can include, but are not limited to, glass or other breakable material; aluminum and/or other metals; plastics such as PET, LDPE, LLDPE, HDPE, PP, PS, PVC, EVOH, and Nylon; paperboard; and the like, or any combination thereof, or any other suitable material.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "outer," "lower," "bottom," "upper," and "top" indicate orientations determined in relation to fully erected and upright cartons.

Figure 1:
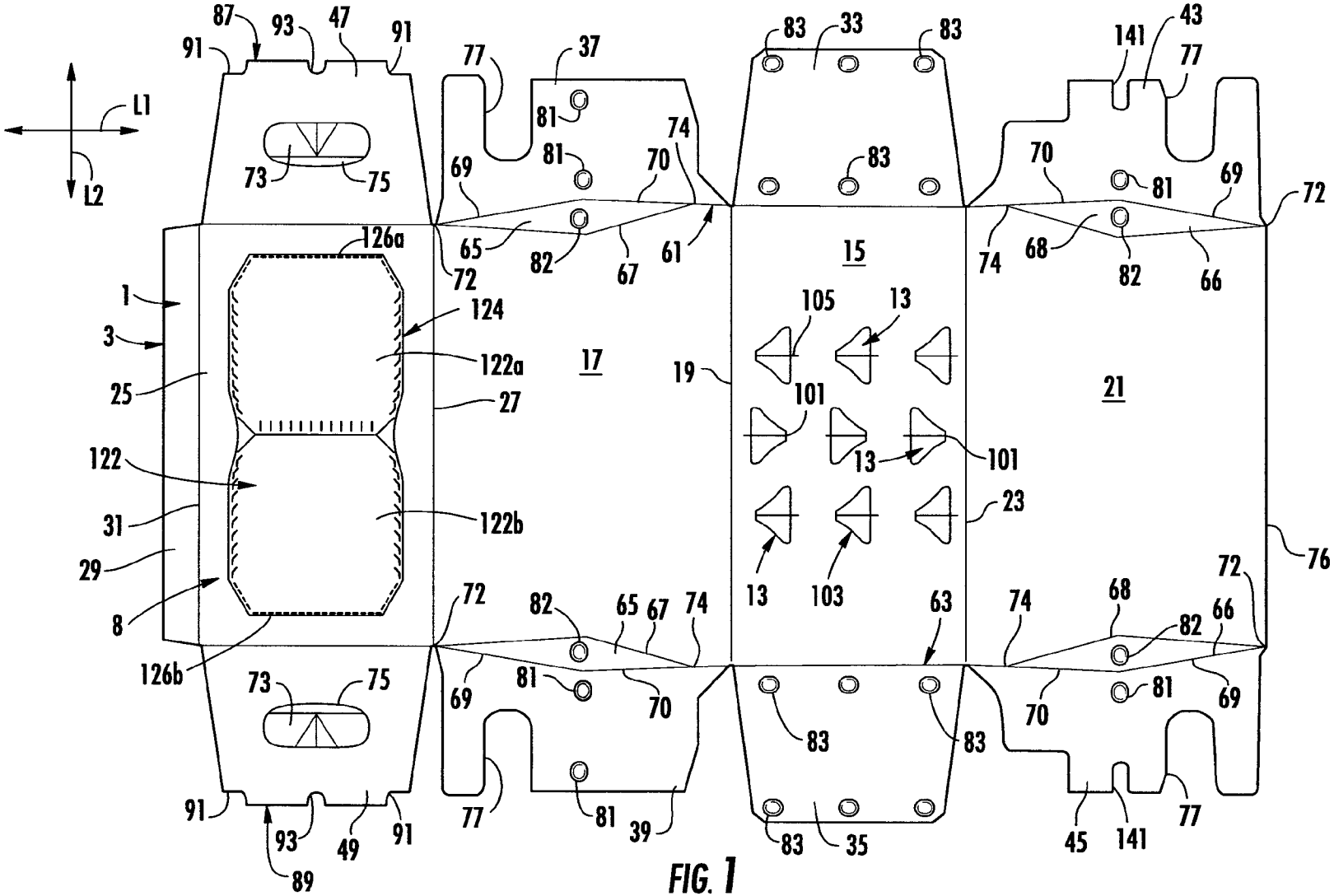
FIG. 1 is a plan view of an exterior surface of a blank for forming a carton according to one exemplary embodiment of the disclosure.
Figure 3:
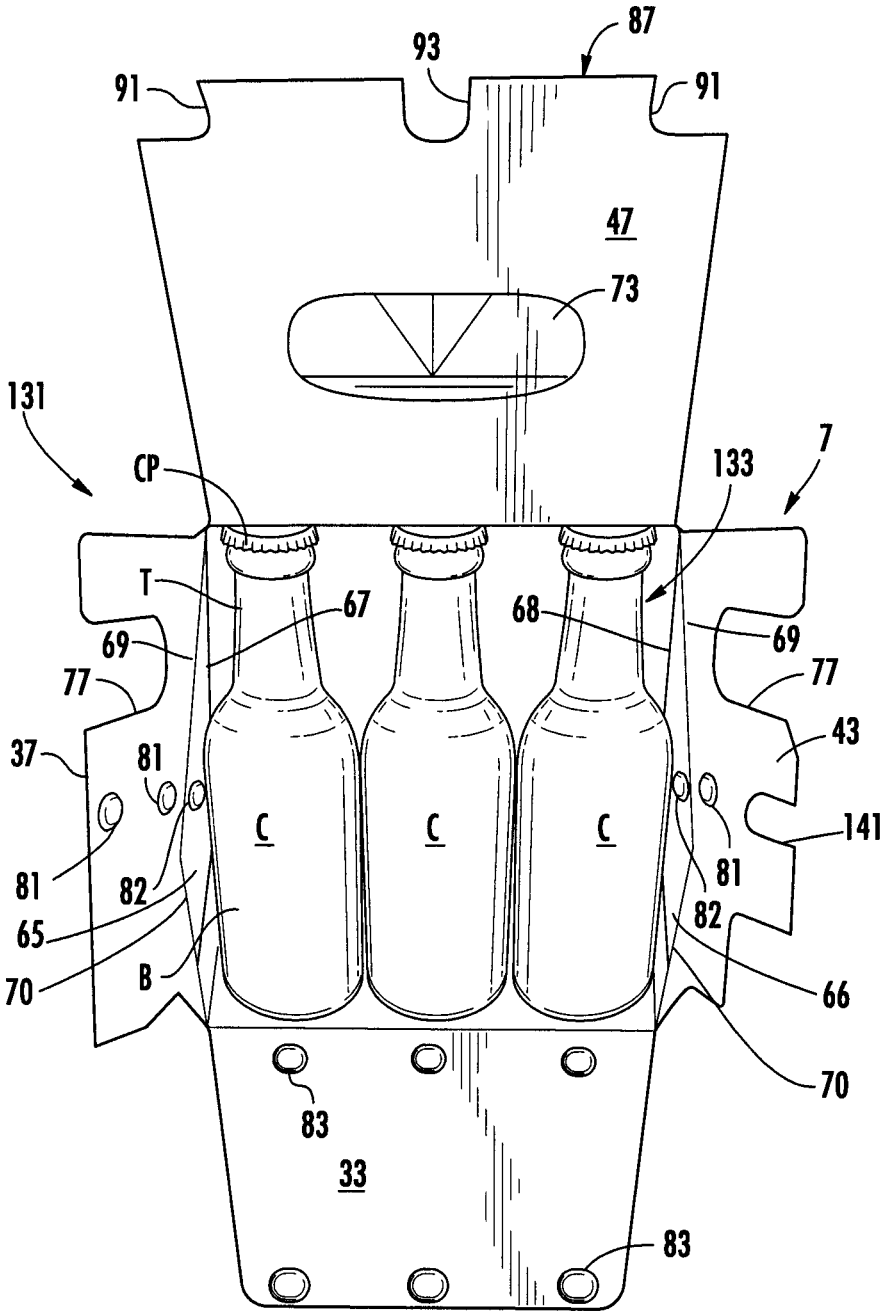
FIG. 3 is an end view of a partially assembled carton showing articles loaded in the partially assembled carton according to the exemplary embodiment of the disclosure.

FIG. 1 is a plan view of the exterior side 1 of a blank, generally indicated at 3, used to form a carton 5 (FIG. 5) according to one exemplary embodiment of the disclosure. The carton 5 can be used to house a plurality of articles such as containers C (FIG. 3). In the illustrated embodiment, the containers C are bottles having a wide bottom B and a narrow top T including a cap CP. In the illustrated embodiment, the carton 5 is sized to house eighteen containers C in a single layer in a 3×6 arrangement, but it is understood that the carton 5 may be sized and shaped to hold containers of a different or same quantity in more than one layer and/or in different row/column arrangements (e.g., 1×6, 2×6, 4×6, 3×8, 2×6×2, 3×4×2, 2×9, 3×4, etc.), or just a single article.

The blank 3 and carton 5 can be similar to any of the embodiments disclosed in the above-noted incorporated by reference patent applications, including U.S. patent application Ser. No. 13/419,740, and all related applications. Accordingly, features in the present application that are similar or identical to features shown in the above-noted incorporated by reference patent application, U.S. patent application Ser. No. 13/419,740, are identified with the same or similar reference numbers between the two applications.

In one embodiment, the carton 5 has a first end 7 and a second end (not shown) each having article protection features 11A, 11B, 11C, 12 (FIG. 5) for protecting at least one article C of the plurality of articles. Alternatively, only a single article C could be provided in the carton 5. Also, the carton 5 may have article protection flaps 13 for protecting the at least one article. The article protection features 11A, 11B, 11C can be formed in one or more end flaps forming the ends of the carton and the article protection feature 12 can be adjacent the respective end flaps. The article protection features 11A, 11B, 11C, 12 cushion a respective article C and prevent or reduce the likelihood of breakage of the articles C. As noted in the incorporated by reference applications, the article protection flaps 13 are moveable between a first position and a second position placed between adjacent containers C in the carton to reduce movement of the containers in the carton and prevent breakage of the containers. The carton 5 can have other features (e.g., handle, dispenser, etc.) without departing from the disclosure.

The blank 3 has a longitudinal axis L 1 and a lateral axis L2. In the embodiment of FIG. 1, the blank includes a bottom panel 15 foldably connected to a first side panel 17 at a lateral fold line 19. A second side panel 21 is foldably connected to the bottom panel 15 at a lateral fold line 23. A top panel 25 is foldably connected to the first side panel 17 at a lateral fold line 27, and foldably connected to an adhesive panel 29 at a lateral fold line 31. Alternatively, the adhesive panel 29 could be foldably connected to the second side panel 21 for being adhered to the top panel 25 to form the carton. In another alternative, the blank 3 could include a second top panel (not shown) foldably connected to the second side panel 21 for being overlapped by the first top panel 25 to form the carton.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a first side end flap 43 and a second side end flap 45. The top panel 25 is foldably connected to a first top end flap 47 and a second top end flap 49. In one embodiment, when the carton 5 is erected, the end flaps 33, 37, 43, 47, close the first end 7 of the carton, and the end flaps 35, 39, 45, 49 close the second end (not shown) of the carton. In accordance with an alternative embodiment of the present disclosure, different flap arrangements can be used for closing the ends of the carton 5.

The end flaps 33, 37, 43, 47 extend along a first marginal area of the blank 3, and are foldably connected at a first longitudinal fold line 61 that extends along the length of the blank. The end flaps 35, 39, 45, 49 extend along a second marginal area of the blank 3, and are foldably connected at a second longitudinal fold line 63 that also extends along the length of the blank. The longitudinal fold lines 61, 63 may be, for example, substantially straight, or offset at one or more locations to account for blank thickness or for other factors.

In one embodiment, the side panels 17, 21 have respective connecting panels 65, 66 that are formed by a respective fold line 67, 68 that is spaced inwardly from the respective longitudinal fold line 61, 63. The connecting panels 65, 66 allow the side end flaps 37, 39, 43, 45 to angle inwardly at each respective end so that the top of the carton 5 at each end (the portion of the fold line 61, 63 connecting the top end flap 47, 49) is closer to the center of the carton than the bottom of the carton at each end (the portion of the fold line 61, 63 connecting the bottom end flap 33, 35). In this way, the ends of the carton, including the first end 7, are tapered ends, but it is understood that the ends of the carton 5 could be otherwise shaped, arranged, and/or configured (e.g., straight or non-tapered) without departing from the disclosure. The tapered ends allow a tight fit of the containers C in the carton.

Figure 2:
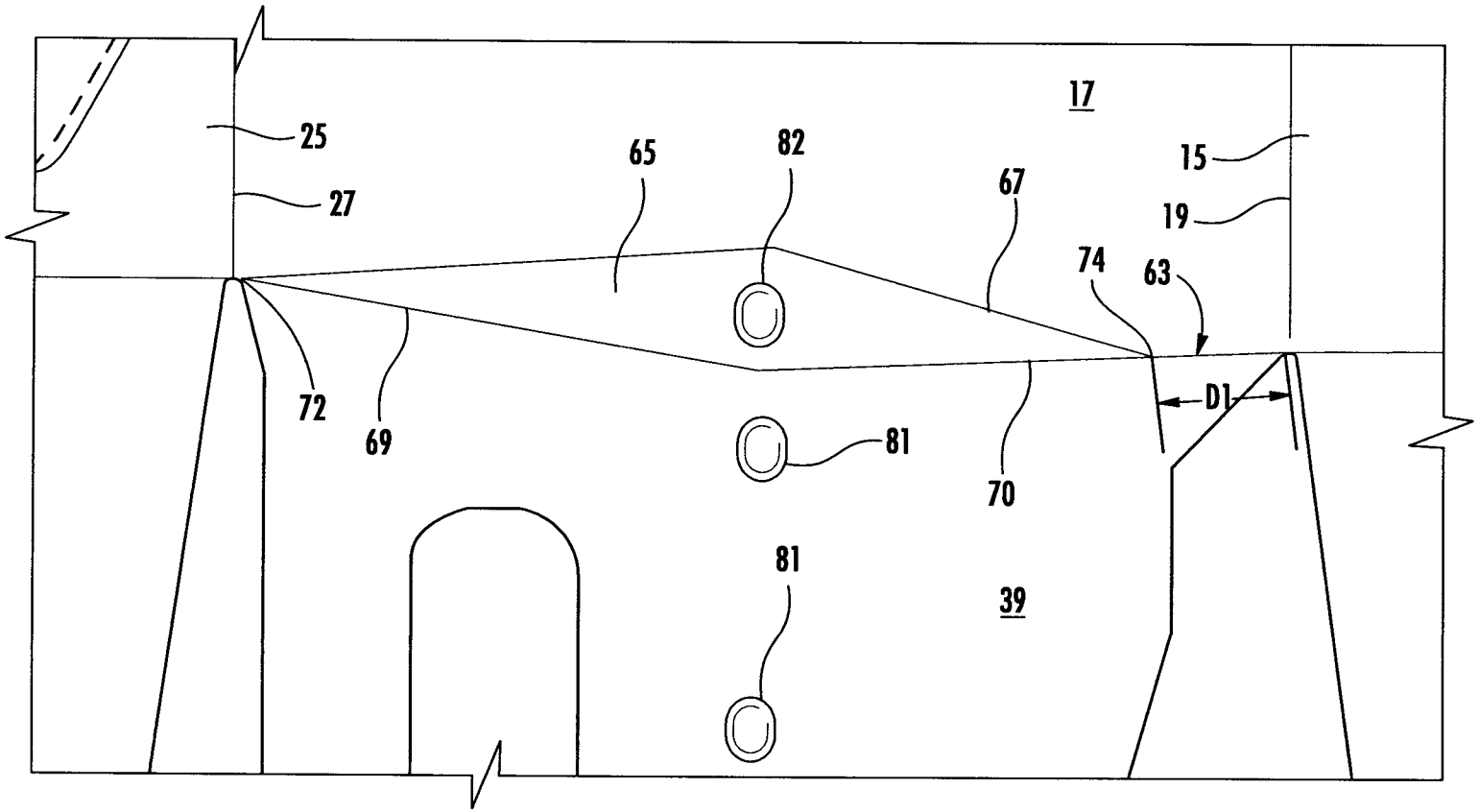
FIG. 2 is an enlarged portion of FIG. 1.
Figure 5:
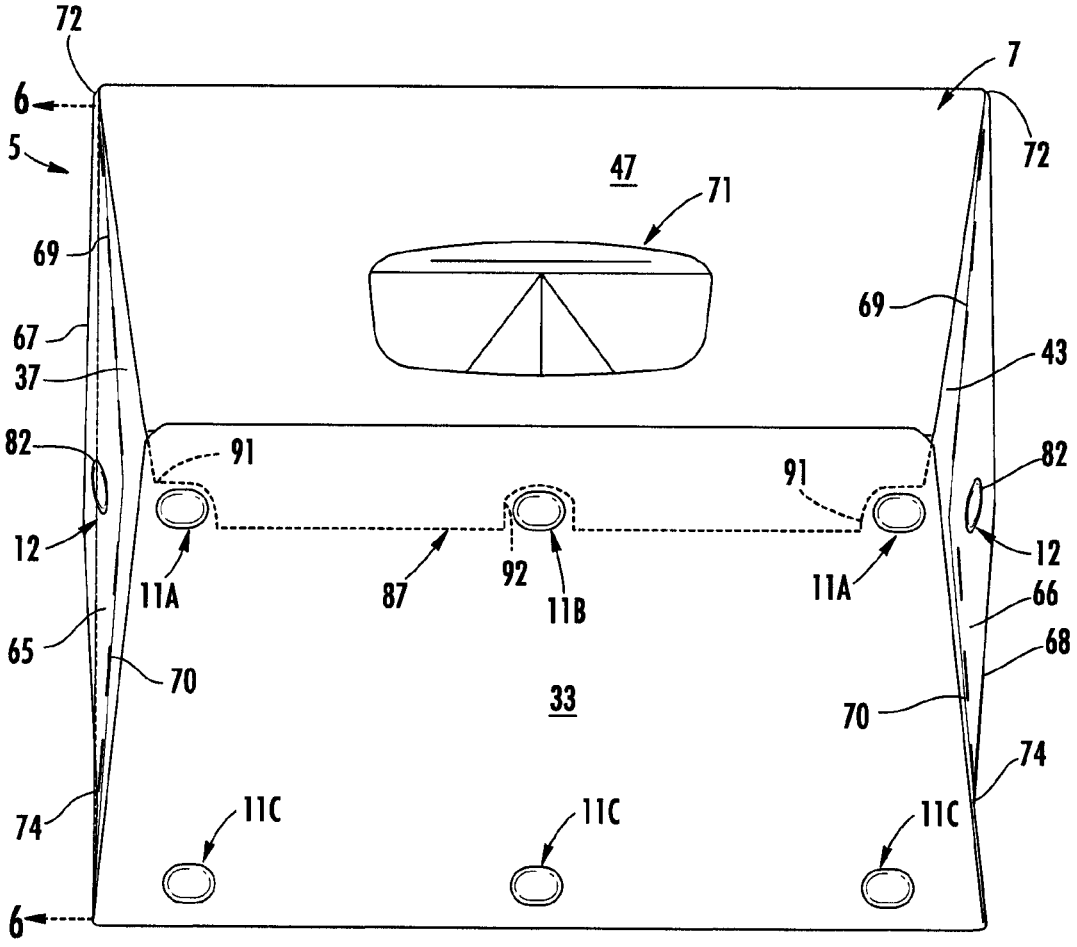
FIG. 5 is an end view showing the carton closed.

As shown in FIGS. 1 and 2, each of the longitudinal fold lines 61, 63 can include an upper (first) portion 69 and a lower (second) portion 70 in each of the side end flaps 37, 43. In one embodiment, the lower portions 70 can be nearly vertical in the erected carton (e.g., FIG. 5A). As shown in FIGS. 1 and 2, the upper portions 69 are generally oblique with respect to the lower portions 70 and the remainders of the longitudinal fold lines 61, 63 so that the ends of the carton slope inwardly in the erected carton (FIG. 5). In the illustrated embodiment, the fold lines 67, 68 are angled and cooperate with the upper portions 69 and lower portions 70 so that the connecting panels 65, 66 generally are in the form of diamond corner panels. The top ends of the fold lines 67 of the connecting panels 65 can intersect or end adjacent the upper portions 69 at or adjacent a respective end of the lateral fold line 27 adjacent the top panel 25 and the top ends of the fold lines 68 of the connecting panels 66 can intersect or end adjacent the upper portions 69 at or adjacent a free edge 76 of the second side panel 21 adjacent the top panel 25 to form a respective upper (first) vertex 72 of each of the connecting panels 65, 66. Additionally, the fold lines 67, 68 can intersect or end adjacent the respective lower portion 70 at a location that is spaced apart from the bottom panel 15 and the lateral fold lines 19, 23 to form a respective lower (second) vertex 74 of each of the connecting panels 65, 66. Accordingly, in the exemplary embodiment, the connecting panels 65, 66 are spaced apart from the bottom panel to form suspended diamond corner panels in the erected carton. In one embodiment, the lower vertices 74 of the connecting panels 65, 66 are spaced apart from the bottom panel a distance D1 (FIG. 2). The connecting panels 65, 66 could be otherwise shaped, arranged, configured and/or omitted without departing from the disclosure. For example, the fold lines 67, 68 could intersect the respective lower portions 70 of the longitudinal fold lines 61, 63 at or adjacent the bottom panel 17.

In the embodiment of FIG. 1, the blank 3 has handle features for forming a handle 71 (FIG. 5) in the closed ends of the carton that are similar to the handle features shown and described in the above-noted incorporated by reference patent application, U.S. patent application Ser. No. 13/419,740, so like or similar reference numbers are used herein to illustrate the same or similar features shown in the '740 application. Accordingly, each of the handles 71 can comprise a handle flap 73 foldably connected to the respective top end flap 47, 49 along a respective fold line 75. The handle flaps 73 can be separable from the respective top end flap 47, 49 along respective cut or fold lines. The handles 71 can also include a cutout 77 in each of the side end flaps 37, 43 and 39, 45 that are overlapped by the respective handle flaps 73 in the handles 71. Accordingly, the cutouts 77 can provide clearance in the side end flaps for folding the handle flaps 73 inwardly in the carton. The handle features could be otherwise shaped, arranged, configured and/or omitted without departing from the disclosure.

In one embodiment, the blank 3 has features for forming the article protection features 11A, 11B, 11C, 12 of the carton 5. As shown in FIG. 1, the side end flaps 37, 39, 43, 45 have deformations in the form of indentations 81 on the exterior surface 1 of the blank 3 such that the indentations from a protrusion on the interior surface of the blank. In the illustrated embodiment, each of the connecting panels 65, 66 of the respective side panels 17, 21 has a deformation in the form of an indentation 82 on the exterior surface 1 of the blank 3 such that the indentations form a protrusion on the interior surface of the blank. In one embodiment, the bottom end flap 33, 35 each have two rows of deformations in the form of indentations 83 on the interior surface of the blank 3 such that the indentations on the interior surface form a protrusion on the exterior surface 1 of the blank 3. As shown in FIG. 1, the top end flaps 47, 49 each have a respective distal edge 87, 89 having corner notches 91 and a center notch 93. The side end flaps 43, 45 each have respective notches 141. The indentations 81, 82, 83 can be any deformation on a surface of a respective side end flaps 37, 39, 43, 45, connecting panels 65, 66, or bottom end flap 33, 35 such that the deformation can be any suitable shape (e.g., a concave depression or protrusion, convex depression or protrusion, flat depression or protrusion, embossed area, debossed area, etc., or any other suitable shape). Furthermore, the indentations 81, 82, 83 could be formed on the interior or exterior surface of one or more of the first side panel 17, second side panel 21, top panel 25, bottom panel 15, or top end flaps 47, 49 without departing from the disclosure, or the indentations could be otherwise shaped, arranged, configured, and/or positioned on the end flaps 37, 39, 43, 45, 33, 35, 47, 49 without departing from the disclosure. Further, one or more of the indentations 81, 82, 83 could be omitted without departing from the disclosure.

In one embodiment, the blank 3 includes nine article protection flaps 13 arranged in a 3×3 arrangement, but the blank could have more or less than nine article protection flaps, and the flaps could be otherwise arranged in other suitable row/column arrangements or in a random configuration on the bottom panel 15, including a single row or single column configuration, or any other suitable configuration. The article protection flaps 13 could be similar or different than the article protection flaps shown and described in the above-noted incorporated by reference patent application, U.S. patent application Ser. No. 13/419,740, so like or similar reference numbers are used herein to illustrate the same or similar features shown in the '740 application. The article protection flaps 13 could be omitted without departing from the scope of this disclosure.

In one embodiment, the blank 3 has features for forming a dispenser 8 in the carton 5. In one embodiment, the dispenser 8 comprises a dispenser panel 122 in the top panel 25 that is defined by a tear line 124. In one embodiment, the dispenser panel 122 has a first portion 122*a* and a second portion 122*b* that are foldably connected to the top panel at respective fold lines 126*a*, 126*b*. The tear line 124 extends between the fold lines 126*a*, 126*b* and is configured to allow separation of the first portion 122*a* from the second portion 122*b*. The dispenser 8 could be otherwise shaped, arranged, configured, positioned, and/or omitted without departing from the disclosure.

Figure 4:
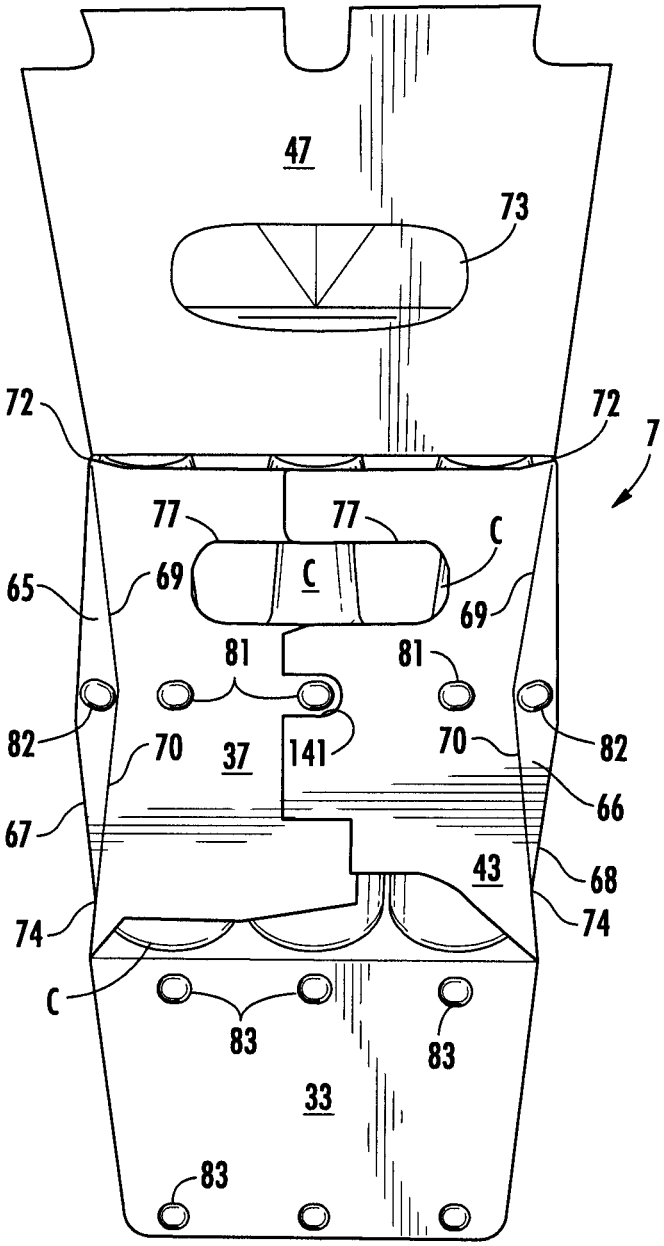
FIG. 4 is a view similar to FIG. 3 but showing the carton further assembled according to the exemplary embodiment of the disclosure.

FIGS. 3-5 show one exemplary method of forming the carton 5 and the article protection features 11A, 11B, 11C, 12. As shown in FIG. 3, the blank 3 can be formed into a sleeve 131 having an open first end 7 or second end (not shown) by folding the bottom panel 15, side panels 17, 21, and top panel 25 along respective fold lines 19, 23, 27, 31. The adhesive panel 29 can be adhesively secured to the second side panel 21 by glue or other suitable adhesive. As shown in FIG. 3, containers C can be placed into an interior space 133 of the sleeve 131. One of the first end 7 and second end (not shown) can be closed prior to loading the containers C or both of the ends can be closed after loading the containers into the interior space 133. The closing of the first end 7 is described below, but it is understood that the second end (not shown) can be closed in a similar manner, with the article protection features 11A, 11B, 11C, 12 in the second end being formed in a similar manner as the article protection features in the first end. Alternatively, the second end could have different flap closing sequence or arrangement and the article protection features 11A, 11B, 11C, 12 could be otherwise shaped, arranged, configured, and/or omitted without departing from the disclosure.

Figure 5A:
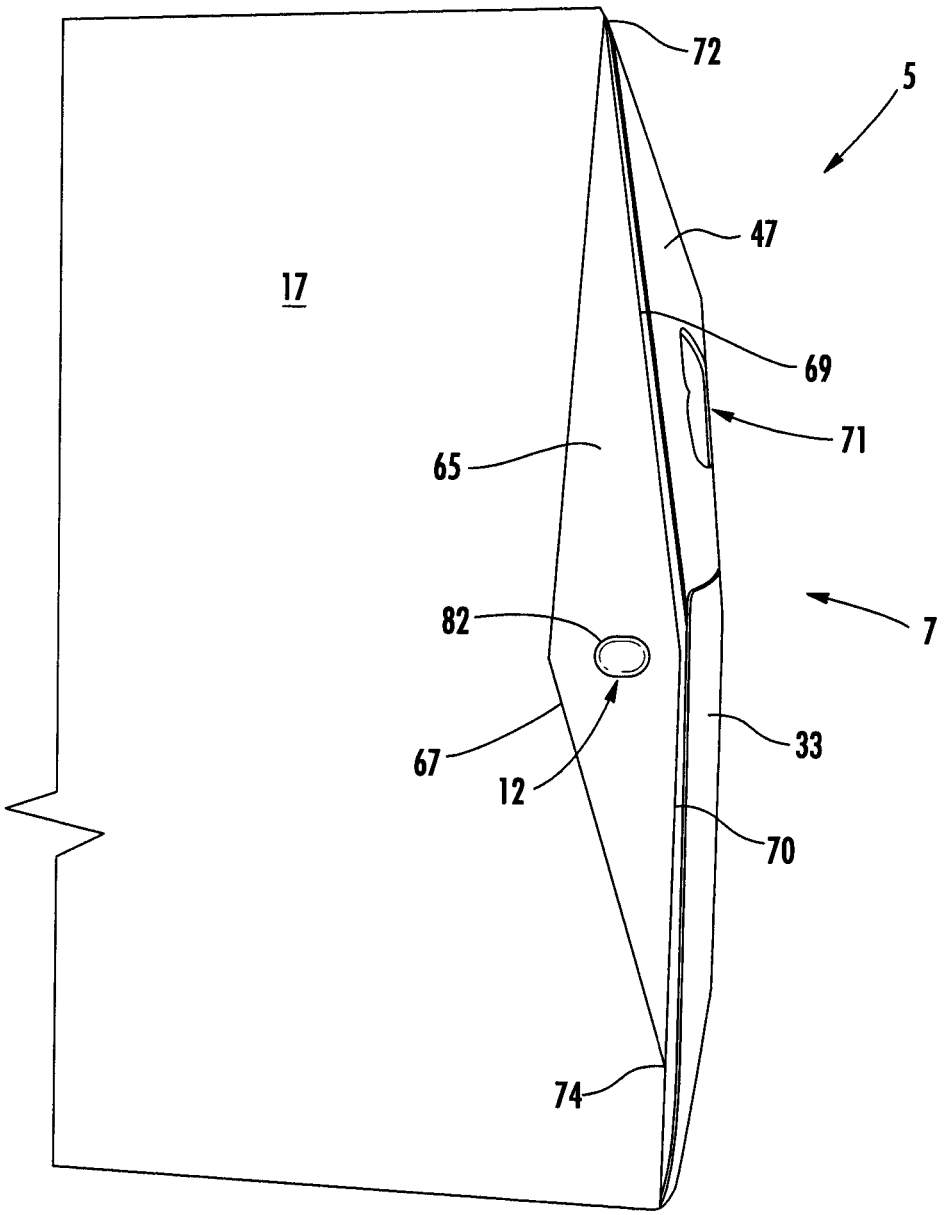
FIG. 5A is a side elevation of a portion of the carton of FIG. 5.

As shown in FIGS. 3-5, the first end 7 is closed by first inwardly folding the side end flaps 37, 43 and then folding the top end flap 47 and the bottom end flap 33 over the end to overlap the side end flaps. As shown in FIG. 4, when the side end flaps 37, 43 are overlapped at the first end 7, the notch 141 in the side end flap 43 is generally aligned with one of the indentations 81 in side end flap 37, and the cutouts 77 in the side end flaps 37, 43 are generally aligned to form a handle opening. In the illustrated embodiment, the connecting panels 65, 66 are folded to extend at an angle with respect to the respective side panels 17, 21 and the respective side end flaps 37, 43. Accordingly, the connecting panels 65, 66 can be positioned at the corners of the carton 5 so that they are pulled tightly against the respectively adjacent containers C at the corners of the carton. As shown in FIGS. 4, 5, and 5A, the lower vertices 74 of the connecting panels 65, 66 at the first end 7 are spaced apart from the bottom panel 15 when the side end flaps 37, 43 are folded over the end. Additionally, the lower portions 70 of the longitudinal fold line 61 extend nearly vertically (e.g., at a small angle with respect to the vertical direction) when viewed from the side of the carton 5 (FIG. 5A). The connecting panels 65, 66, the fold lines 67, 68, and/or the portions 69, 70 of the longitudinal fold lines 61, 63 could be otherwise shaped, arranged, configured, and/or omitted without departing from the disclosure. For example, the lower portions 70 could extend at any suitable angle.

As shown in FIG. 5, the top end flap 47 is downwardly folded and the bottom end flap 33 is upwardly folded to close the end 7 of the carton 5. The article protection features 11A, 11B, 11C in the first end of the carton 5 are formed during the closing of the end flaps 33, 37, 43, 47. The indentations 81 on the exterior surface of the side end flaps 37, 43 are aligned with the indentations 83 on the interior surface of the bottom end flap 33 to form a respective article protection feature. The outermost article protection features are identified by reference number 11A and are formed by an indentation 81 on each of the side end flaps 37, 43 and respective indentations 83 on the bottom end flap 33 that cooperate to form respective pockets in the overlapped end flaps. The middle article protection feature 11B is formed by an indentation 81 on the side end flap 43 and an indentation 83 on the bottom end flap 33. The edge 87 of the top end flap 47 is shown in phantom in FIG. 5 to show that the corner notches 91 are aligned with the respective outermost article protection features 11A and the center notch 92 is aligned with the middle article protection feature 11B. The lower article protection features 11C are formed by the indentations 83 on the bottom end flap 33 adjacent the longitudinal fold line 81. The article protection features 11A, 11B, 11C could be otherwise shaped, arranged, positioned, configured, and/or omitted without departing from the disclosure.

Figure 6:
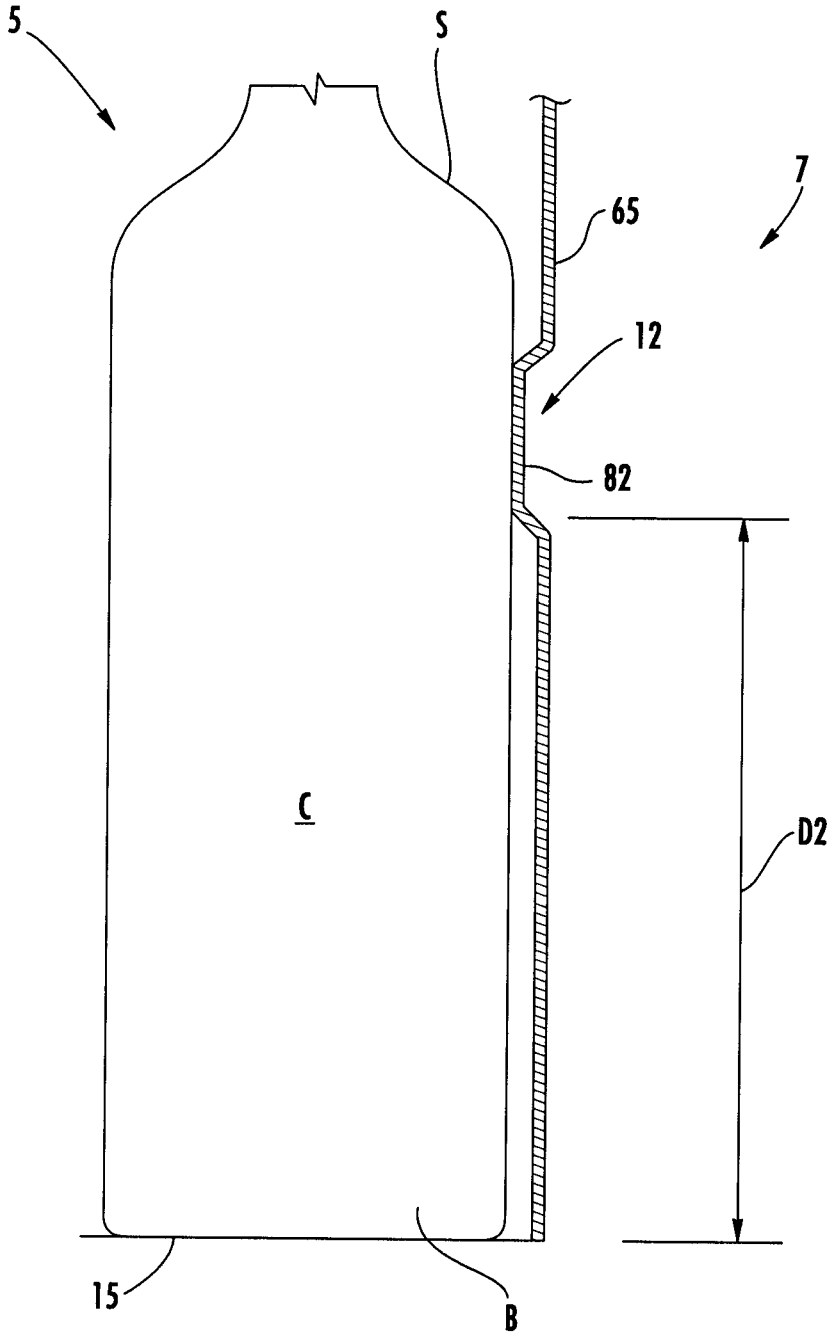
FIG. 6 is a cross-section taken along the plane 6-6 of FIG. 5.

The article protection features 12 are formed by positioning the indentation 82 on each of the connecting panels 65, 66 during closing of the end flaps 33, 37, 43, 47. As shown in FIGS. 5 and 5A, the article protection features 12 are formed by a respective indentation 82 when the connecting panels 65, 66 are positioned adjacent to a respective corner container C in the carton 5. When the end flaps 33, 37, 43, 47 are closed, the indentations 82 in the connecting panels 65, 66 are positioned to be in contact with the respective corner containers C that are adjacent a respective connecting panel to provide a tight fit and provide cushioning to the corner containers. As schematically shown in FIG. 6, the article protection feature 12 in the connecting panels 65, 66 is spaced apart from the bottom panel 15 by a distance D2 so that the article protection feature 12 contacts the container C near the shoulder S of the container. In one embodiment, for each of the connecting panels 65, 66, the nearly vertical portion 70 of the fold line 61 or 63 (FIG. 5A) and the spacing of the respective lower vertices 74 from the bottom panel 15 (FIGS. 5 and 5A) can further help secure the containers C in the carton 5. For example, since the connecting panels 65, 66 are suspended (e.g., spaced apart from the bottom panel 15) and the lower portions 70 are nearly vertical, there is a shorter distance than the full height of the carton for the connecting panels 65, 66 to slope inwardly from the larger bottom panel 15 to the smaller top panel 25. Accordingly, the connecting panels 65, 66 can extend at a steeper angle and can be pushed tighter against the shoulders S of the respective containers C in the corners of the carton 5. Accordingly, the containers C can be compacted in the interior of the carton to help reduce movement of the containers relative to one another. Additionally, the article protection feature 12 at each connecting panel 65, 66 can further help compact the containers C by pushing against the corner containers adjacent the connecting panels. The article protection feature 12 and/or the connecting panels 65, 66 could be otherwise shaped, arranged, configured, and/or located without departing from the disclosure. The carton 5 could be formed by other forming steps without departing from the disclosure.

Figure 7:
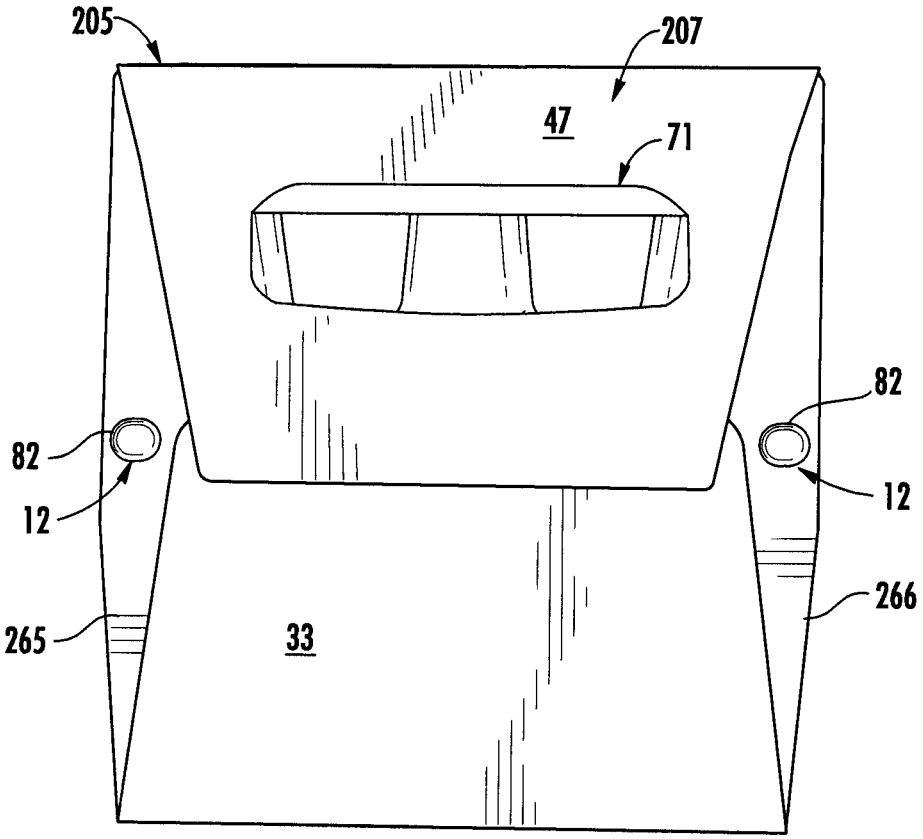
FIG. 7 is an end view of a carton according to an alternative embodiment of the disclosure.

FIG. 7 is an end view of a carton according to an alternative embodiment of the disclosure. The alternative embodiment is generally similar to the embodiment of FIGS. 1-6, except for variations noted and variations that will be apparent to one of ordinary skill in the art. Accordingly, similar or identical features of the embodiments have been given like or similar reference numbers. As shown in FIG. 7, the closed end 207 of the carton 205 includes the top end flap 47 overlapping the bottom end flap 33, and the end flaps 47, 33 overlap the side end flaps 37, 43 (not shown). The connecting panels 265, 266 at the closed end 207 form diamond corner panels extending from the bottom panel (not shown) to the top panel (not shown). In another embodiment, the connecting panels are omitted. As shown in FIG. 7, the article protection features 11A, 11B, 11C are omitted in the closed end 207. Further, in the embodiment of FIG. 7, the article protection flaps 13 can be omitted without departing from the disclosure. Alternatively, the article protection flaps 13 can be included in the embodiment of FIG. 7 without departing from the disclosure. As shown in FIG. 7, the indentations 82 are included in the connecting panels 265, 266 to form the article protection features 12 at the corners of the carton 205. The carton 205, the connecting panels 265, 266, and/or the article protection features could be otherwise shaped, arranged, and/or configured without departing from the disclosure.

The cartons of any of the illustrated or non-illustrated embodiments of the disclosure could have other features (e.g., dispenser features, handle features, reinforcement features, etc.) without departing from the disclosure. Also, the cartons could be otherwise shaped, arranged, or configured and the cartons could be configured to hold articles other than beverage containers C without departing from the disclosure.

Any of the features of the various embodiments of the disclosure can be combined with, replaced by, or otherwise configured with other features of other embodiments of the disclosure without departing from the scope of this disclosure. Further, it is noted that the connecting panels (e.g., suspended diamond corner panels) and/or the article protection features of the various embodiments can be incorporated into a carton having any carton style or panel configuration. The carton styles and panel configurations described above are included by way of example.

In general, the blanks of any of the illustrated or non-illustrated embodiments may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing at least one article, the carton comprising:

a plurality of panels that extends at least partially around an interior of the carton;

at least two end flaps respectively foldably connected to respective panels of the plurality of panels, the at least two end flaps being at least partially overlapped with respect to one another to thereby at least partially form a closed end of the carton, at least one end flap of the at least two end flaps being connected to a respective panel of the plurality of panels by a connecting panel;

a first article protection feature for protecting the at least one article, the first article protection feature being positioned on the connecting panel, wherein the first article protection feature comprises a protrusion on an interior side of the connecting panel, the protrusion projecting at least partially into the interior of the carton;

at least one second article protection feature formed in the at least two end flaps;

wherein the at least two end flaps comprise a first end flap and a second end flap, the second end flap at least partially overlapping the first end flap, and the at least one second article protection feature comprises a first protrusion formed in the first end flap and a second protrusion formed in the second end flap, the first protrusion being at least partially aligned with the second protrusion.

2. The carton of claim 1, wherein the protrusion of the first article protection feature is for contacting a shoulder portion of the at least one article.

3. The carton of claim 1, wherein the at least two end flaps are foldably connected to the respective panels of the plurality of panels along a first fold line, and the connecting panel is at least partially defined by the first fold line and a second fold line extending in at least one panel of the plurality of panels.

4. The carton of claim 3, wherein the first fold line comprises a first portion and a second portion that is generally oblique with respect to the first portion, and the second fold line intersects the first portion of the first fold line at a first vertex and the second portion of the first fold line at a second vertex.

5. The carton of claim 4, wherein the at least one panel is a first panel and the plurality of panels further comprises a second panel foldably connected to the first panel along a first transverse fold line, and the second vertex is spaced apart from the second panel and the first transverse fold line.

6. The carton of claim 5, wherein the plurality of panels further comprises a third panel foldably connected to the first panel along a second transverse fold line, and the first vertex intersects the second transverse fold line adjacent the third panel.

7. The carton of claim 1, wherein the plurality of panels comprises at least a side panel foldably connected to a bottom panel, and the connecting panel comprises a suspended corner panel at least partially defined by a first fold line extending in at least the side panel, the suspended corner panel and the first fold line being spaced apart from the bottom panel.

8. The carton of claim 7, wherein the plurality of panels further comprises a top panel foldably connected to the side panel along a transverse fold line, the top panel being smaller than the bottom panel, and the connecting panel extends adjacent the top panel, the fold line intersecting the transverse fold line.

9. The carton of claim 7, wherein the at least one end flap comprises a side end flap foldably connected to the side panel along a second fold line, and the suspended corner panel is further defined by the second fold line.

10. The carton of claim 9, wherein:

the side panel is a first side panel, the side end flap is a first side end flap, and the suspended corner panel is a first suspended corner panel;

the plurality of panels further comprises a second side panel, and the at least two end flaps comprises a second side end flap foldably connected to the second side panel along the second fold line; and the carton further comprises a second suspended corner panel at least partially defined by the second fold line and a third fold line extending in at least the second side panel, the second suspended corner panel and the third fold line being spaced apart from the bottom panel.

11. The carton of claim 1, wherein the first article protection feature comprises an indentation on an exterior side of the connecting panel.

12. The carton of claim 1 in combination with a plurality of articles, wherein the first article protection feature contacts a side portion of an article of the plurality of articles.

13. A blank for forming a carton for containing at least one article, the blank comprising:

a plurality of panels for at least partially extending around an interior of the carton formed from the blank;

at least two end flaps respectively foldably connected to respective panels of the plurality of panels, the at least two end flaps for being at least partially overlapped with respect to one another to at least partially form a closed end of the carton formed from the blank, at least one end flap of the at least two end flaps being connected to a respective panel of the plurality of panels by a connecting panel;

a first article protection feature for protecting the at least one article when the carton is formed from the blank, the first article protection feature being positioned on the connecting panel, wherein the first article protection feature comprises a protrusion on an interior side of the connecting panel, the protrusion being for projecting at least partially into the interior of the carton formed from the blank;

at least one second article protection feature formed in the at least two end flaps;

wherein the at least two end flaps comprise a first end flap and a second end flap, the at least one second article protection feature comprises a first protrusion formed in the first end flap and a second protrusion formed in the second end flap, and the second end flap being for at least partially overlapping the first end flap so that the first protrusion is at least partially aligned with the second protrusion when the carton is formed from the blank.

14. The blank of claim 13, wherein the at least two end flaps are foldably connected to the respective panels of the plurality of panels along a first fold line, and the connecting panel is at least partially defined by the first fold line and a second fold line extending in at least one panel of the plurality of panels.

15. The blank of claim 14, wherein the first fold line comprises a first portion and a second portion that is generally oblique with respect to the first portion, and the second fold line intersects the first portion of the first fold line at a first vertex and the second portion of the first fold line at a second vertex.

16. The blank of claim 15, wherein the at least one panel is a first panel and the plurality of panels further comprises a second panel foldably connected to the first panel along a first transverse fold line, and the second vertex is spaced apart from the second panel and the first transverse fold line.

17. The blank of claim 16, wherein the plurality of panels further comprises a third panel foldably connected to the first panel along a second transverse fold line, and the first vertex intersects the second transverse fold line adjacent the third panel.

18. The blank of claim 13, wherein the plurality of panels comprises at least a side panel foldably connected to a bottom panel, and the connecting panel comprises a suspended corner panel at least partially defined by a first fold line extending in at least the side panel, the suspended corner panel and the first fold line being spaced apart from the bottom panel.

19. The blank of claim 18, wherein the plurality of panels further comprises a top panel foldably connected to the side panel along a transverse fold line, the top panel being smaller than the bottom panel, and the connecting panel extends adjacent the top panel, the fold line intersecting the transverse fold line.

20. The blank of claim 18, wherein the at least one end flap comprises a side end flap foldably connected to the side panel along a second fold line, and the suspended corner panel is further defined by the second fold line.

21. The blank of claim 20, wherein:

the side panel is a first side panel, the side end flap is a first side end flap, and the suspended corner panel is a first suspended corner panel;

the plurality of panels further comprises a second side panel, and the at least two end flaps comprises a second side end flap foldably connected to the second side panel along the second fold line; and the blank further comprises a second suspended corner panel at least partially defined by the second fold line and a third fold line extending in at least the second side panel, the second suspended corner panel and the third fold line being spaced apart from the bottom panel.

22. The blank of claim 13, wherein the first article protection feature comprises an indentation on an exterior side of the connecting panel.

23. The blank of claim 13, wherein the first article protection feature is for contacting a side portion of the at least one container when the carton is formed from the blank.

24. A method of forming a carton for containing at least one article, the method comprising:

obtaining a carton blank comprising a plurality of panels, at least two end flaps respectively foldably connected to respective panels of the plurality of panels, a first article protection feature for protecting the at least one article, and at least one second article protection feature formed in the at least two end flaps, wherein at least one end flap of the at least two end flaps is connected to a respective panel of the plurality of panels by a connecting panel and the first article protection feature is positioned on the connecting panel, wherein the first article protection feature comprises a protrusion on an interior side of the connecting panel, and wherein the at least two end flaps comprise a first end flap and a second end flap and the at least one second article protection feature comprises a first protrusion formed in the first end flap and a second protrusion formed in the second end flap;

forming an interior of the carton at least partially defined by the plurality of panels, the forming the interior of the carton comprising forming an open-ended sleeve; and at least partially forming a closed end of the carton by at least partially overlapping the at least two end flaps with respect to one another, the at least partially forming the closed end comprising positioning the connecting panel so that the protrusion of the first article protection feature projects at least partially into the interior of the carton and positioning the second end flap to at least partially overlap the first end flap so that the first protrusion of the second article protection feature is at least partially aligned with the second protrusion of the second article protection feature.

25. The method of claim 24, further comprising positioning at least one article in the interior of the carton, the at least partially forming the closed end of the carton comprising positioning the connecting panel to be adjacent the at least one article so that the first article protection feature is at least partially in contact with the at least one article.

26. The method of claim 24, wherein the at least two end flaps are foldably connected to the respective panels of the plurality of panels along a first fold line, the connecting panel is at least partially defined by the first fold line and a second fold line extending in at least one panel of the plurality of panels, and the at least partially overlapping the at least two end flaps comprises folding the at least one end flap and the connecting panel along the first fold line and the second fold line.

27. The method of claim 26, wherein the second fold line intersects the first fold line at an upper vertex and at a lower vertex, the connecting panel generally comprises a diamond corner panel extending from the lower vertex to the upper vertex.

28. The method of claim 27, wherein the plurality of panels comprises a top panel, a side panel foldably connected to the top panel, and a bottom panel foldably connected to the side panel, the upper vertex is disposed adjacent the top panel, and the lower vertex is spaced apart from the bottom panel and the top panel.

* * * * *